United States Patent [19]

Jessop

[11] Patent Number: 4,566,919

[45] Date of Patent: Jan. 28, 1986

[54] SENSITIZED CAST EMULSION EXPLOSIVE COMPOSITION

[75] Inventor: Harvey A. Jessop, Lehi, Utah

[73] Assignee: IRECO Incorporated, Salt Lake City, Utah

[21] Appl. No.: 597,415

[22] Filed: Apr. 5, 1984

[51] Int. Cl.[3] ..... C06B 45/08

[52] U.S. Cl. ..... 149/20; 149/38; 149/39; 149/43; 149/44; 149/46; 149/47; 149/48; 149/49; 149/50; 149/55; 149/56; 149/57; 149/61; 149/85; 149/92; 149/93; 149/94; 149/99; 149/100; 149/105

[58] Field of Search ..... 149/2, 20, 92, 93, 43, 149/38, 39, 105, 46, 61, 44, 41, 42, 48, 49, 50, 47, 55, 56, 57, 40, 94, 85, 96, 99, 100, 109.6

[56] References Cited

U.S. PATENT DOCUMENTS 4,343,663 8/1982 Breza et al. ..... 149/18 X

*Primary Examiner*—Stephen J. Lechert, Jr.

[57] ABSTRACT

The invention relates to a cast explosive composition having a relatively high density and energy and a critical diameter no larger than about 150 mm at a temperature of 5° C. The composition comprises inorganic oxidizer salt consisting primarily of ammonium nitrate, a water-immiscible organic liquid fuel, less than about 5% water, a sensitizer and an emulsifier which allows formation of a water-in-oil emulsion at an elevated formulation temperature but which also allows the emulsion to weaken and the inorganic oxidizer salt to crystallize at lower or ambient temperatures to produce a cast composition.

12 Claims, No Drawings

SENSITIZED CAST EMULSION EXPLOSIVE COMPOSITION

The present invention relates to an explosive composition. More particularly, the invention relates to a cast explosive composition having a relatively high density and energy and a critical diameter no larger than about 150 mm at a temperature of 5° C. By "cast" is meant an unflowable or unextrudable mass which is fluid when formulated at an elevated temperature but which sets or hardens upon cooling to ambient temperature. This allows the composition to be "poured" or "cast" while fluid into a container of desired form for hardening in that form. The compositions of the present invention, although hardened, also remain machinable into further desired shapes.

The compositions of the present invention are formulated at an elevated temperature by forming a water-in-oil emulsion, which, when allowed to cool, forms a cast composition. The composition comprises inorganic oxidizer salt consisting primarily of ammonium nitrate, a water-immiscible organic liquid fuel, less than about 5% water, a sensitizer to provide a critical diameter no larger than about 150 mm at a temperature of 5° C., and an emulsifier of a particular type which allows formation of a water-in-oil emulsion at the elevated formulation temperature but which also allows the emulsion to weaken and the inorganic oxidizer salt to crystallize at lower or ambient temperatures to produce a cast composition.

Water-in-oil emulsion explosives are well known in the art. See, for example, U.S. Pat. Nos. 4,356,044; 4,322,258; and 4,141,767. Such explosives contain a continuous phase of a water-immiscible organic liquid fuel and a discontinuous phase of an emulsified aqueous inorganic oxidizer salt solution. Normally, these explosive compositions contain a density reducing agent for sensitivity purposes. These compositions have a grease-like consistency which renders them water-resistant and generally easily extrudable.

Past efforts have focused upon preparing a stable emulsion explosive composition and thus upon preventing or minimizing breakdown, or weakening, of the emulsion and resulting crystallization of the inorganic oxidizer salt solution which is initially dispersed throughout the continuous fuel phase. This was accomplished by employing generally about 8% or more water, to reduce the crystallization temperature of the oxidizer salt solution, and emulsifiers that are particularly stable against emulsion breakdown. In contrast, the present invention employs less than about 5% water and a type of emulsifier that does not form a particularly stable emulsion and thus will allow weakening of the emulsion and resulting crystallization of the oxidizer salt to occur so that the composition becomes cast in form.

Low water emulsions are known from U.S. Pat. No. 4,248,644, which discloses an emulsion explosion composition in the form of a "melt-in-fuel" wherein the melt comprises ammonium nitrate as the discontinuous phase and the composition is substantially water-free. The composition, however, includes an emulsifying agent of the type which imparts to it a "greasy consistency" even after cooling to ambient temperature. Thus low water by itself does not insure the formation of a cast composition. The cast compositions of the present invention require the combination of low water and the emulsifiers particularly described herein.

The compositions of the present invention have advantageous properties. A need exists for a relatively inexpensive but castable explosive composition which can be poured while hot into containers of various forms but which when allowed to cool, becomes cast or hardened in the form of the container. Heretofore, such types of explosives were formed from self-explosives such as TNT, Composition B, pentolite, etc. These compositions, however, are relatively expensive. The cast compositions of the present invention have similar physical properties to these cast self-explosives, including high density and energy; however, the ingredient costs are considerably less. Thus a major advantage of the present invention is to provide a castable, machinable explosive composition comprising relatively inexpensive ingredients. The compositions also are relatively safe for handling and processing. In addition, even though the composition loses its grease-like consistency upon cooling and crystallization of the oxidizer salt, it retains adequate water resistance due to the hardened characteristic of its surface. For ease of handling, the compositions remain fluid for a period of time even after cooling to below the salt crystallization temperature.

SUMMARY OF THE INVENTION

The invention comprises a cast explosive composition comprising inorganic oxidizer salt, consisting primarily of ammonium nitrate; a water-immiscible organic liquid fuel; less than about 5% water; a sensitizer to provide a critical diameter no larger than about 150 mm at a temperature of 5° C. and an emulsifier which allows formation of a water-in-oil emulsion at an elevated formulation temperature but also allows the emulsion to weaken and the inorganic oxidizer salt to crystallize at ambient temperatures to produce a cast composition. The composition is formulated by first forming a water-in-oil emulsion at a temperature above the crystallization temperature of the inorganic oxidizer salt and then allowing the emulsion to cool into a cast form.

DETAILED DESCRIPTION OF THE INVENTION

When initially formulated at an elevated temperature, the compositions of the present invention have a grease-like consistency and are in the form of a water-in-oil emulsion. This is advantageous for a number of reasons. The emulsion form allows the oxidizer salts to be finely and intimately dispersed throughout the continuous fuel phase to enhance ease of reaction of oxidizer and fuel. The oxidizer salt is dispersed throughout the fuel phase initially as droplets of solution at an elevated temperature, and as the composition cools, the precipitation of the salts within the droplets is physically inhibited resulting in the formation of fine salt crystals which enhance intimacy between oxidizer and fuel. Another advantage is that a grease-like emulsion is fluid and can be pumped or extruded as desired. As the emulsion cools, the grease-like nature is not lost immediately since crystallization of the salts occurs slowly, and thus the composition retains its emulsion-like handling characteristics for some period of time after cooling below the salt crystallization temperature. This allows the composition to be handled initially as an emulsion even at lower temperatures. Thus the addition of other ingredients, such as solid sensitizers or density reducing agents, can be accomplished at lower temperatures; shrinkage and/or cavity formation after placement into a container can be minimized; and risks to personnel of handling high temperature material can be reduced. A non-emulsion composition, when cooled below the ingredient crystallization or melting temperature, would rapidly harden.

The inorganic oxidizer salt is employed in an amount of from about 25% to about 92% by weight of the total composition. The oxidizer salt is primarily ammonium nitrate but minor amounts of other salts may be employed preferably in an amount of up to about 20%. The other oxidizer salts are selected from the group consisting of alkali and alkaline earth metal nitrates, chlorates and perchlorates. Of these, sodium nitrate and potassium nitrate are preferred. Perchlorates may be employed in amounts up to 40%. Preferably from about 10% to about 65% of the total oxidizer salt is added in particle or prill form.

The immiscible organic liquid fuel forming the continuous phase of the composition at the time of its formulation at an elevated temperature is present generally in an amount of from about 1.5% to about 15% by weight of the total composition. The actual amount used can be varied depending upon the particular immiscible fuel(s) used and upon the presence of other fuels, if any. The immiscible organic liquid fuels can be aliphatic, alicyclic and/or aromatic and can be saturated and/or unsaturated, so long as they are liquid at the formulation temperature. Preferred fuels include mineral oil, waxes, paraffin oils, benzene, toluene, xylenes and mixtures of liquid hydrocarbons generally referred to as petroleum distillates such as gasoline, kerosene and diesel fuel. Particularly preferred liquid fuels are mineral oil, No. 2 fuel oil, paraffin waxes, microcrystalline waxes and mixtures thereof. Aliphatic and aromatic nitro-compounds also can be used. Halogenated organic liquids can be used in amounts up to about 25%. Mixtures of the above can be used.

Water is employed in an amount of about 5% or less of the total composition. Water miscible organic liquids can partially replace water as a solvent for the salts, and such liquids also function as a fuel for the composition. Miscible liquid fuels can include alcohols such as methyl alcohol, glycols such as ethylene glycol, amides such as formamide, and analogous nitrogen-containing liquids. The use of low amounts of water is an important aspect of this invention.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Liquid fuels include those water-miscible fuels described above. A particularly preferred solid fuel is particulate aluminum which can be employed in amounts up to about 50% by weight to increase the density and energy of the composition. Although granular, atomized or paint grade aluminum can be used, atomized is preferred.

A sensitizer is employed to provide a critical diameter no larger than about 150 mm at a temperature of 5° C. The critical diameter is the smallest charge diameter in which the explosive will detonate reliably at the temperature given. Because of the relatively high density of the compositions of the present invention, preferably 1.50 g/cc or more, a sensitizer is employed to provide adequate sensitivity. Sensitizers may be selected from the group consisting of particulate metals, molecular explosives and mixtures of these ingredients. Particulate aluminum or other metallic particles can be used in an amount ranging up to about 50% by weight. The aluminum particles can be paint grade, atomized or granular. Examples of particulate molecular explosives are pentaerythritol tetranitrate (PETN), cyclotrimethylene trinitramine (RDX), trinitrotoluene (TNT), cyclotetramethylene tetranitramine (HMX), and nitrocellulose. Other types of molecular explosives are water soluble salts such as amine nitrates or perchlorates, including monomethylamine or ethylenediamine nitrates, and alkanolamine salts such as ethanolamine nitrate or perchlorate.

The molecular explosive may be used in an amount ranging from about 10% up to about 70% by weight, and preferably up to about 45%. A preferred sensitizer is RDX, alone or in combination with atomized aluminum.

The emulsifier is a key ingredient in the compositions of the present invention. The emulsifier must be capable of forming a water-in-oil emulsion at an elevated formulation temperature. In addition, the emulsifier must allow the emulsion to weaken upon cooling and the inorganic oxidizer salt in solution to crystallize at temperatures below the solution crystallization temperature. Thus the emulsion should be inherently unstable in the present compositions to allow salt crystallization to occur so that the composition becomes cast in form. Emulsifiers which have been found to produce compositions with these properties include a fatty amine having the following formula: $RNH_2$, wherein R has a chain length ranging from 12 to 22 carbon atoms, an acid salt of such fatty amine; disodium ethoxylated nonyl phenol half ester of sulfosuccinic acid; complex organic phosphate ester (Syn Fac 9214) and sucrose stearate. These examples represent the anionic, cationic, and nonionic emulsifier classes. The emulsifier allows the formation of a water-in-oil emulsion at an elevated formulation temperature but also allows the emulsion to weaken and the inorganic oxidizer salt to crystallize at ambient temperatures to produce a cast composition. The emulsifier is employed in an amount of from about 0.2% to about 5% by weight. Preferably the emulsifier contains a saturated hydrocarbon chain as its lipophilic portion, although the unsaturated form can be used even though it tends to form a more stable emulsion than the saturated form and thus may not form a cast as easily or as quickly. Preferably, the fatty amine or salt thereof emulsifier has a chain length of from 14 to 18 carbon atoms, and more preferably, the fatty amine is an alkylammonium salt composed of saturated molecules having a chain length of from 14 to 18 carbon atoms. The fatty amine emulsifiers of the present invention also may function as crystal habit modifiers in that they control oxidizer salt crystal growth and prevent the formation of larger desensitizing crystals.

Although it is desirable that the compositions of the present invention have a high density to perform similarly to cast self-explosives which generally have densities in excess of 1.5 g/cc or more, the compositions can be reduced from their natural densities by addition of a density reducing agent such as small hollow particles of which plastic or glass spheres and perlite are examples. In addition, gas bubbles can be entrained into the composition during formulation or can be introduced by a small amount of a chemical gassing agent such as sodium nitrite, which decomposes chemically in the composition to produce gas bubbles. The use of density reducing agents to increase sensitivity is well known in the art.

The compositions of the present invention are formulated by first forming a melt, or a solution if water is present, of the oxidizer salt(s) at an elevated temperature above the salt crystallization or solidification temperature. This melt or solution then is added to a solution of the emulsifier and the immiscible organic liquid fuel, which can be at ambient or an elevated temperature, while stirring with sufficient vigor to produce an emulsion of the oxidizer salt melt or solution in a continuous organic liquid fuel phase. Usually this can be accomplished essentially instantaneously with rapid stirring. Stirring should be continued until the formulation is uniform. The sensitizer and other ingredients, if any, then are added and stirred throughout the formulation by conventional means. The formulation process also can be accomplished in a continuous manner as is known in the art. The solid, particulate sensitizer and any particulate oxidizer salt generally are added at ambient temperature which results in a cooling of the overall formulation to a temperature below the freezing or crystallization temperature of the oxidizer salt. As previously mentioned, crystallization of the oxidizer salt occurs over some period of time, even at temperatures below the crystallization temperature, allowing the resulting composition to remain fluid for ease in handling, even when containing up to 60% solids. The rate of hardening is dependent upon the degree of refinement of the original emulsion, and the amount and intensity of shear it receives during handling while it is below the crystallization temperature. The type of emulsifier and organic liquid fuel also influence the hardening rate. It is advantageous to predissolve the emulsifier in the organic liquid fuel prior to adding the organic liquid fuel to the oxidizer salt melt or solution. This method allows the emulsion to form quickly and with minimum agitation. The emulsifier can be added separately and just prior to emulsification, however, if desired or if, for example, the emulsifier would degrade at the elevated temperature of the fuel.

Reference to the following Table further illustrates the invention.

Example A contained RDX as the sole sensitizer, had a density of 1.65 g/cc but yet was sensitive to a No. 12 cap in a diameter as small as 25 mm. Example B contained RDX and 30% atomized aluminum as a combined sensitizer, had a density of 1.81 g/cc and was detonable in small diameters as well. Example B had an extremely high energy (2211 cal/g) due to the presence of the aluminum. In formulating Example B, the emulsion was formed at 130° C. (the AN and SN salt combination had a crystallization temperature of 120° C.) and was cooled to 80° C. by the addition of ambient temperature aluminum and RDX. The resulting composition still handled as a grease for well over an hour after mixing in the solids. Examples C-E show other ingredient variations. Examples F and G contain potassium nitrate as an additional oxidizer salt, and Example G contains a high amount of sensitizer (70% RDX). Examples of other emulsifiers which were found to produce cast compositions in accordance with the invention include disodium ethoxylated nonyl phenol half ester of sulfosuccinic acid; complex organic phosphate ester (Syn Fac 9214).

The compositions of the present invention can be used in most common explosives applications. Because they have similar physical and chemical properties to cast self-explosives, they can be used as a less expensive replacement for self-explosives, such as in boosters, munition fills, artillary shells, etc. Because the compositions are extrudable and/or pumpable when initially formulated, they can be loaded into containers of various configurations for various applications.

While the present invention has been described with reference to certain illustrative examples and preferred embodiments, various modifications will be apparent to those skilled in the art. In any such modifications are intended to be within the scope of the invention as set forth in the appended claims.

TABLE

| Composition Ingredients (Parts by Weight) | A | B | C | D | E | F | G |
|---|---|---|---|---|---|---|---|
| AN | 46.2 | 32.3 | 43.2 | 40.3 | 57.6 | 31.6 | 21.0 |
| SN | 13.8 | 9.7 | 12.0 | 11.2 | 16.0 | — | — |
| KN | — | — | — | — | — | 6.4 | 4.2 |
| $H_2O$ | — | — | — | — | — | 3.2 | 2.1 |
| Emulsifier[a] | 0.6 | 0.4 | 0.6 | 0.6 | 0.8 | 0.5 | 0.3 |
| Mineral Oil | 3.4 | 2.4 | 4.2 | 3.9 | 5.6 | — | — |
| Fuel Oil | — | — | — | — | — | 3.3 | 1.8 |
| RDX | 36.0 | 25.2 | 20.0 | 44.0 | 20.0 | 20.0 | 70.0 |
| Atomized aluminum | — | 30.0 | 20.0 | — | — | 35.0 | — |
| Density (g/cc) | 1.65 | 1.81 | 1.75 | 1.70 | 1.66 | 1.82 | 1.67 |
| Detonation Velocity (km/sec) at 20° C. | | | | | | | |
| Diameter (mm) | | | | | | | |
| 150 | 7.9 | 7.6 | — | — | — | — | — |
| 100 | 7.4 | 7.2 | — | — | — | 7.5 | — |
| 75 | 7.4 | 7.2 | 8.5 | — | — | 7.1 | — |
| 63 | 7.2 | 6.4 | 5.3 | — | — | 7.1 | — |
| 50 | 6.9 | 6.4 | — | 7.5 | 5.3 | 5.3 | 8.5 |
| 38 | 6.7 | 6.4 | 5.3 | — | — | 4.5 | — |
| 25 | 6.4 | Det | — | — | — | Fail | — |
| Minimim Booster[b], Det/Fail | #12/#8 | 8g/#12 | 8g/#8 | 8g/— | 8g/#8 | 8g/#12 | #5/#4 |

Key:
[a]Alkylammonium acetate compound of saturated molecules having a chain length of from 12 to 18 carbon atoms.
[b]"8g" represents an 8 gram pentolite booster and the numbers refer to blasting cap numbers.

What is claimed is:

1. A cast explosive composition, which comprises a water-in-oil emulsion when formulated at an elevated temperature but which becomes cast upon cooling due to a weakening or breakdown of the emulsion, further comprising inorganic oxidizer salt primarily consisting of ammonium nitrate; a water-immiscible organic liquid fuel; less than about 5% water by weight of the total composition; a sensitizer to provide a critical diameter no larger than about 150 mm at a temperature of about 5° C.; and an emulsifier which allows the formation of a water-in-oil emulsion at an elevated formulation temperature but which allows the emulsion to become unstable and the inorganic oxidizer salt to crystallize at ambient temperature to produce a cast composition.

2. A composition according to claim 1 wherein the emulsifier is selected from the group consisting of a fatty amine having the following formula: $RNH_2$, wherein R has a chain length ranging from 12 to 22 carbon atoms; an acid addition salt of such fatty amine; disodium ethoxylated nonyl phenol half ester of sulfosuccinic acid; complex organic phosphate ester and sucrose stearate.

3. A composition according to claim 2 wherein the emulsifier is saturated.

4. A composition according to claim 2 wherein the emulsifier has a chain length ranging from 14 to 18 carbon atoms.

5. A composition according to claim 3 wherein the emulsifier is alkylammonium acetate.

6. A composition according to claim 1 wherein the sensitizer is selected from the group consisting of trinitrotoluene, cyclotrimethylenetrinitramine, pentaerythritoltetranitrate, cyclotetramethylenetetranitramine, particulate aluminum, nitrocellulose, and mixtures thereof.

7. A composition according to claim 6 wherein the sensitizer is cyclotrimethylenetrinitramine in an amoount of at least about 10% by weight of the total composition.

8. A composition according to claim 6 wherein the sensitizer comprises a mixture of cyclotrimethylenetrinitramine and particulate aluminum.

9. A composition according to claim 8 wherein the cyclotrimethylenetrinitramine is present in an amount of at least about 10% and the aluminum is present in an amount of at least about 20%.

10. A composition according to claim 1 including up to about 20% of an additional inorganic oxidizer salt selected from the group consisting of sodium nitrate and potassium nitrate.

11. A composition according to claim 1 wherein up to about 40% of the inorganic oxidizer salt is a perchlorate.

12. A method of formulating a cast explosive composition comprising (a) forming a water-in-oil emulsion comprising inorganic oxidizer salt consisting primarily of ammonium nitrate, less than about 5% water, a water-immiscible organic liquid fuel, and an emulsifier which allows the formation of a water-in-oil emulsion at an elevated formulation temperature but which allows the emulsion to weaken or become unstable and the inorganic oxidizer salt to crystallize at ambient temperature to produce a cast composition; said emulsion being formed at a temperature above the crystallization temperature of the inorganic oxidizer salt in the emulsion; (b) dispersing a sensitizer throughout the emulsion to provide a critical diameter no larger than about 150 mm at a temperature of about 5° C.; and (c) allowing the emulsion to cool to a temperature below the crystallization temperature so that the inorganic oxidizer salt crystallizes to form a cast composition.

* * * * *